US008192084B2

(12) United States Patent
Dolenc

(10) Patent No.: US 8,192,084 B2
(45) Date of Patent: Jun. 5, 2012

(54) ANTI-DRIP SANDWICH BAG

(76) Inventor: Ted Dolenc, Sammamish, WA (US)

( * ) Notice: Subject to any disclaimer, the term of this patent is extended or adjusted under 35 U.S.C. 154(b) by 936 days.

(21) Appl. No.: 12/221,298

(22) Filed: Aug. 1, 2008

(65) Prior Publication Data

US 2009/0003734 A1 Jan. 1, 2009

(51) Int. Cl.
*B65D 33/00* (2006.01)

(52) U.S. Cl. ..... 383/33; 383/36; 229/938

(58) Field of Classification Search ..... 383/33, 383/36; 229/902, 938, 87.08; 248/94, 95, 248/99; 215/41, 392; 220/495.08, 719, 906, 220/495.03, 731

See application file for complete search history.

(56) References Cited

U.S. PATENT DOCUMENTS

| | | | | |
|---|---|---|---|---|
| 2,352,503 | A * | 6/1944 | Walton | 53/173 |
| 4,610,039 | A * | 9/1986 | Stern | 4/285 |
| 5,582,319 | A * | 12/1996 | Heyes et al. | 220/62.22 |
| 5,964,534 | A | 10/1999 | Wells | |
| 6,502,715 | B2 * | 1/2003 | Miorelli | 220/719 |
| 2005/0269386 | A1 * | 12/2005 | Fisher et al. | 229/87.06 |
| 2007/0031068 | A1 * | 2/2007 | Gillis | 383/33 |

* cited by examiner

*Primary Examiner* — Nathan J Newhouse
*Assistant Examiner* — Nina Attel

(57) ABSTRACT

A bag made of water resistant paper or plastic for holding a "goopy" sandwich such as a hamburger, hot dog, etc while eating the same is fitted on the open end with a collar extending generally radially from the bag. The collar or drip plate is adapted to catch liquids, slurries, and small particles falling from the sandwich. The catchings are either retained on the collar or directed back into the bag where they either soak into the sandwich or run to the bottom of the bag. In either case, the drippings do not fall onto the diner, table, or floor.

4 Claims, 2 Drawing Sheets

ANTI-DRIP SANDWICH BAG

RELATED APPLICATION

None

U.S. GOVERNMENT INTEREST IN THE INVENTION

None

BACKGROUND OF THE INVENTION

1. Field of the Invention

Food containers, namely paper or plastic carrying and serving bags for transporting and then holding the food during eating.

A paper bag is fitted with a surrounding tray to catch drips of mayonnaise, catsup, meat and vegetable juices, particles of food, and the like.

2. Description of Related Art

Restaurants and fast food vendors usually wrap their goods, mainly hamburgers, in a sheet of paper or shallow waterproof bag. These provide sanitary coverings for holding the food, but if the food is drippy with mayonnaise, catsup, tomato, juices, etc material can drip from the food and not be caught within the wrap or bag. The present invention recognized the need for more containment of these common problems to keep both the eater, the table, and the floor of the restaurant clean.

The literature in the US patent files shows several deep bags for carrying sandwich like food, and the sandwich may be pushed to the top to be exposed and positioned for eating. However, these have no advantage over the more common shallow bag or wrap during eating.

U.S. Pat. No. 5,964,534 by Theodore Wells is an improvement over the more common food bag or wrap. Mr. Wells includes a surplus of material at the top that can be folded back and extend somewhat from the hamburger or sandwich. The folds are comprised of soft flexible material and do not prevent liquids and slurries from escaping. Indeed, the skirt formed by folding parts of the bag film outwardly are described as directing drips into the bag or away from the user, over his hand. The drips directed into the bag are not retained by the shielding skirt, and the drips directed away are not retained, but allowed to drip off the shield skirt. The present invention can retain the drips, or permit them to be controllably poured off of the retainer.

3. Objects of the Invention

It is an object of the invention to provide controlled capture of food drips and droppings from a hamburger, hot dog, sandwich, or similar finger food.

It is another object of the invention to retain the drips and droppings on a drip tray integral with a carrying/holding bag.

It is another object of the invention to permit controlled removal or dumping of the retained drips from the drip tray.

BRIEF SUMMARY OF THE INVENTION

A bag made of water resistant paper or plastic for holding a "goopy" sandwich such as a hamburger, hot dog, etc while eating the same is fitted on the open end with a collar extending generally radially from the bag. The collar or drip plate is adapted to catch liquids, slurries, and small particles falling from the sandwich. The catchings are either retained on the collar or directed back into the bag where they either soak into the sandwich or run to the bottom of the bag. In either case, the drippings do not fall onto the diner, table, or floor.

TABLE OF IDENTIFIED DETAILS

1. Overall sandwich bag.
2. The sandwich holding bag portion.
3. The drip tray
4. The upturned edge of the drip tray
5. The sandwich bag opening
6. An hamburger is illustrated

DETAILED DESCRIPTION OF THE INVENTION

Figure 1:
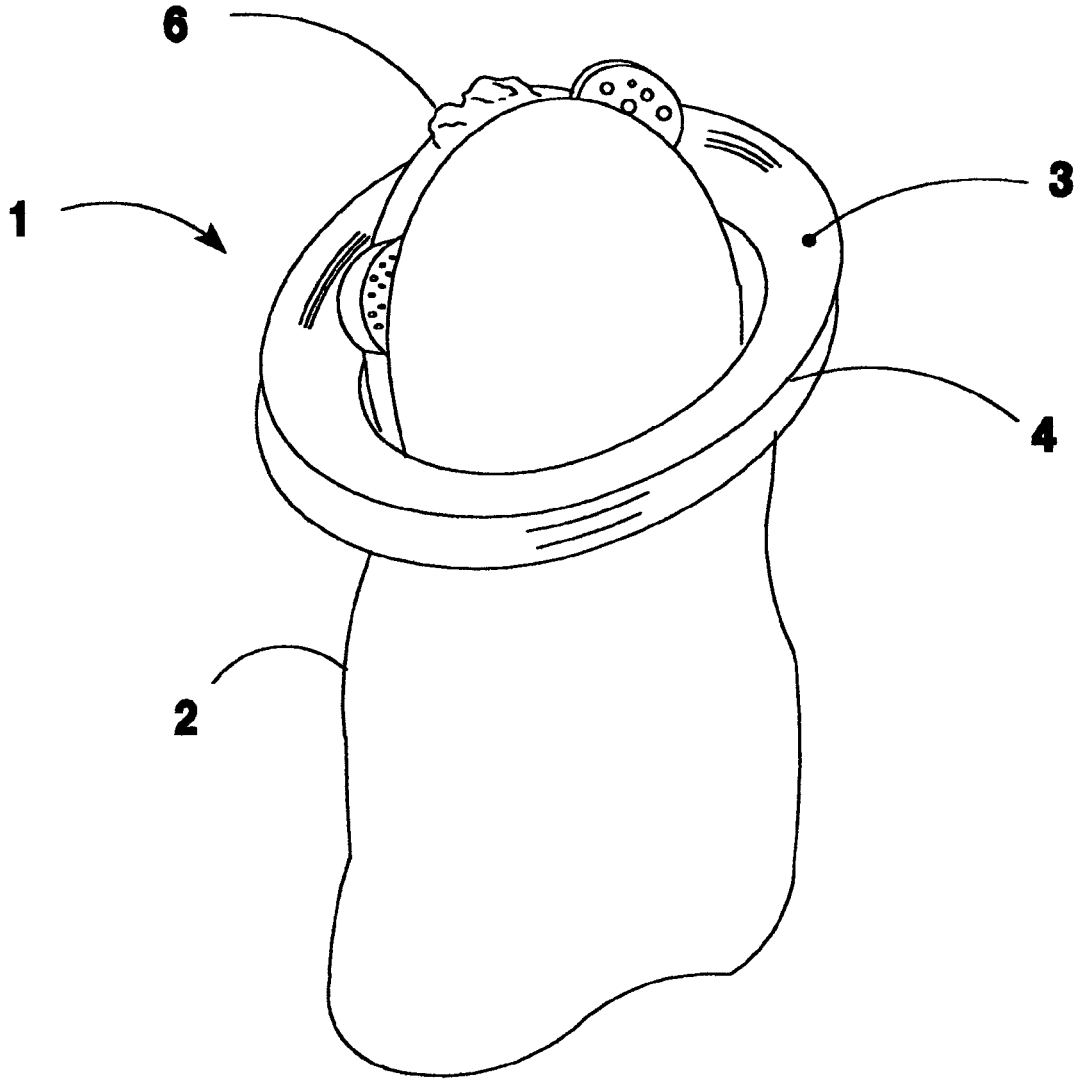
FIG. 1 depicts the sandwich bag holding a hamburger.

Referring to FIG. 1; The invention depicted as 1 is shown holding an exemplary sandwich, in this case an hamburger 6. A bag 2, that is sufficiently large, generally tubular in form, having a closed bottom, and water and grease resistant, is adapted to encase the expected type of sandwich is topped with a collar 3 generally extending from the bag opening. The collar has sufficient stiffness and water resistance to catch and hold any liquid, slurry, or particles that might drip from the sandwich. The outer rim of collar 3 has an upward extending ring 4 to prevent the drippings from falling off the collar.

Figure 2:
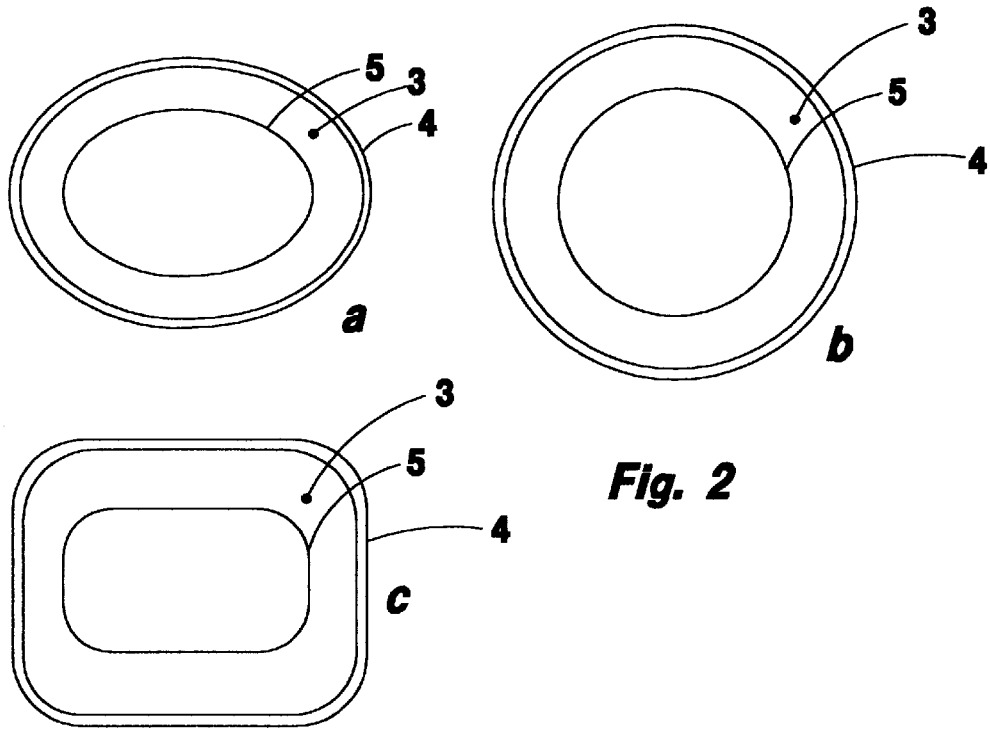
FIG. 2 is a top view of various bag opening shapes.

Referring to FIG. 2; Collar 3 and the associated bag opening 5 is sculpted to fit the expected type of sandwich. In particular, an oval for sandwiched served in a hamburger type bun, approximately round for hot dogs and submarine sandwiches, and approximately rectangular for sliced bread sandwiches.

Figure 3:
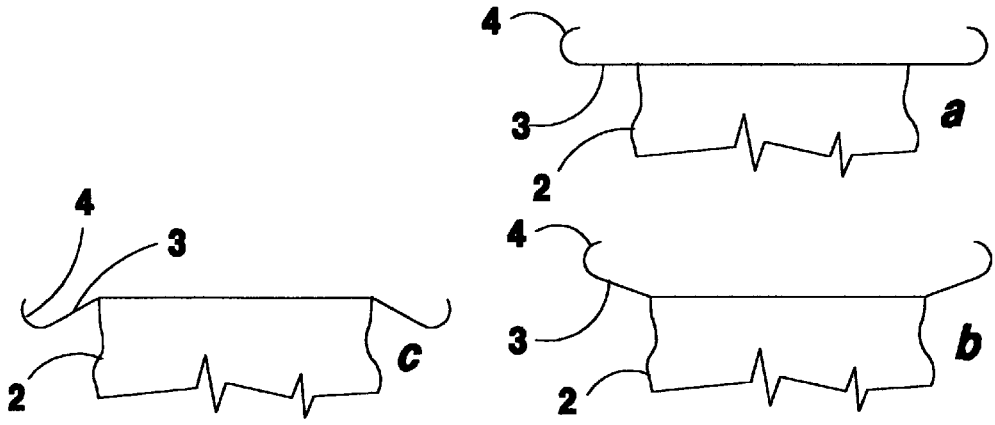
FIG. 3 shows sectional views of various embodiments of the drip tray.

Referring to FIG. 3; The collar 3 serving as a drip tray with upturned rim ring 4 may be radial from the bag opening 5 as shown in detail (a) or slanted upwardly as shown in detail (b), or downwardly as shown in detail (c). The upturned rim ring 4 is shown as a retro-curve, but other shapes such as a straight vertical wall, a wall with a beaded edge for strength, a straight wall set at an acute angle with the collar will also work. A rim ring wall set at an obtuse angle will work, but may more easily be overtopped when the collar is tipped unless the ring wall is quite large. The choice is made by considering functional characteristics and manufacturing processes.

When the collar is squeezed slightly and is bent downward creating a valley, the upturned edge will tend to flatten into a pouring lip and the caught drippings will run to the valley to be in position to be poured out of the collar drip tray.

Embodiment (a) can be folded flat against the bag for boxing for distribution to the food industry. Embodiments (b) and (c) can also be folded but will take up more room within a shipping box.

Embodiment (b) causes the drippings to run back into the bag and/or be absorbed into the sandwich. Embodiment (c) retains the drippings at the edge, the upturn may be larger than that of the other two embodiments, and can hold more. However, the diner must use care not to tip the collar too much and cause the catchings to overflow the retaining ring.

The bag can be attached to the collar tray by any of several means. The whole bag/collar assembly 1 can be molded in one piece or a bag element can be glued or welded to the collar in a second operation. That allows the bag and collar to be fabricated and optionally printed separately. The bag may be attached to the flat portion of the collar or the collar may have a short downward or upward tubular section to which the bag is secured. The bag may be long enough to surround the sandwich serving as a closed carrying device from the dispensing counter to the dining table or transport vehicle. Alternatively, the bag may be as short as one half the sandwich length, and the sandwich will then be served in ready-to-eat position.

The preferred materials are plastic or plastsized paper. One piece molded plastic can provide sufficient strength and water proofness to perform as intended and can be easily mass produced. Papers having suitable characteristic are well known, available, and biodegradable, but will require more fabrication steps.

The choice is based on economics of fabrication, ecology, and distribution.

How to Use the Invention

The anti-drip sandwich bag is unpacked from the shipping container, opened, and a prepared sandwich inserted. The sandwich may be inserted totally for carrying and delivery, or partly, ready to eat. The diner holds the sandwich with the collar in an approximately horizontal attitude and proceeds to eat it, pushing the sandwich upward as needed. The drippings may be poured out as needed, or allowed to be re-absorbed into the sandwich. When finished, the bag is folded around the collar and discarded.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The embodiments of the invention in which an exclusive property right or privilege is claimed are defined as follows:

I claim:

1. A holder for a sandwich comprising: a liquid resistant bag having an essentially tubular form with an open top and closed bottom; a drip catching collar for catching and retaining material originating from a protruding sandwich; said drip catching collar attached to said open top of said bag; said drip catching collar comprising an annular ring having a first inner edge at said open top of said bag, wherein said annular ring extends from said first inner edge generally radially outward from and encircling said open top of said bag to an upwardly turned curved portion; said upwardly turned curved portion comprising a second terminating edge wherein said second terminating edge faces generally inwardly toward said open top of said bag; said ring further comprises a first horizontal length from said first inner edge to an outer most edge of said upwardly turned curved portion and a second horizontal length from said outer most edge of said upwardly turned curved portion to said second terminating edge wherein said second horizontal length is less than said first horizontal length such that said second terminating edge does not extend past said open top of said bag; and whereby said annular ring, said upwardly turned curved portion and said second terminating edge of said drip catching collar form a channel for catching and retaining loose material while said drip catching collar is in a tilted attitude.

2. The holder of claim 1, wherein said drip catching collar is approximately oval shaped.

3. The holder of claim 1, wherein said drip catching collar is approximately circular.

4. The holder of claim 1, wherein said drip catching collar is approximately rectangular shaped.

* * * * *